US005946948A

United States Patent [19]

Cho

[11] Patent Number: 5,946,948

[45] Date of Patent: Sep. 7, 1999

[54] CLOTHES WASHER HAVING A PULSATOR APPARATUS

[75] Inventor: In-Su Cho, Kwangju, Rep. of Korea

[73] Assignee: Daewoo Electronics, Co., Ltd., Seoul, Rep. of Korea

[21] Appl. No.: 09/050,909

[22] Filed: Mar. 31, 1998

[30] Foreign Application Priority Data

Apr. 16, 1997 [KR] Rep. of Korea ..... 97-13908

[51] Int. Cl.[6] ..... D06F 17/08

[52] U.S. Cl. ..... 68/23.6; 68/133; 68/134

[58] Field of Search ..... 68/23.6, 23.7, 68/53, 131, 132, 133, 134

[56] References Cited

U.S. PATENT DOCUMENTS

| | | | |
|---|---|---|---|
| 5,661,990 | 9/1997 | Chong | 68/23.6 |
| 5,746,071 | 5/1998 | Youn | 68/133 X |
| 5,850,750 | 12/1998 | Cho | 68/133 |

*Primary Examiner*—Philip R. Coe

*Attorney, Agent, or Firm*—Pillsbury, Madison, & Sutro LLP

[57] ABSTRACT

In a clothes washer having a main pulsator 4 which is rotatably disposed in a clothes basket 3, the driving force transmitting apparatus 17 is disposed in a chamber 12 partitioned by the horizonal plate. The driving force of the motor 5 transmits simultaneously and directly to each main pulsator and sub-pulsator which constitutes a series of bevel gears.

7 Claims, 3 Drawing Sheets

CLOTHES WASHER HAVING A PULSATOR APPARATUS

BACKGROUND OF THE INVENTION

1. Field of the Invention

The present invention relates to a clothes washer having a main pulsator and plural sub-pulsators, and more particularly to a clothes washer by which a driving force of a motor is directly and simultaneously transferred to a main pulsator and plural sub-pulsators via a driving force transmitting apparatus.

2. Description of the Prior Art

Generally, a clothes washer is operated by predetermined modes, e.g., a water supplying mode for supplying water to a clothes basket, a clothes washing mode for washing clothes by water supplied in the water supplying mode, a rinsing mode for rinsing clothes after completion of the clothes washing mode, and a dehydrating mode for dehydrating the clean clothes after the rinsing mode.

FIG. 3 illustrates the typical clothes washer which is operated by a series of modes. A water basket 2 for housing an amount of water is provided in a rectangular housing 1. The water basket 2 is shaped as a hollow cylinder for preventing the interruption of swirling water during the clothes washing mode, and is suspended in the housing via a suspension rod 7.

That is, a damper 7*a* is provided at each of four spots of the bottom portion of circumferential outer surface of the water basket 2. Each damper 7*a* is connected to one lower end of a suspension rod 7, while the other upper end of the suspension rod 7 is connected in suspension to a bracket (not shown) which is mounted at an upper portion of inner surface of the housing 1.

Moreover, the cylindrical clothes basket 3 is rotatably disposed in the water basket 2. The clothes basket 3 has plural openings 3*a* through which the water supplied into the clothes basket 3 flows toward the water basket 2. Thus, the water level of the clothes basket 3 is the same as that of the water basket 2. Dirty water dehydrated from the water absorbing clothes during the dehydrating mode and a lint flow through the openings to the water basket 2.

Moreover, a weight balancer (not shown) is provided at the circumference of an upper rim of the clothes basket 3 to reduce the vibration of the clothes basket 3 during the dehydrating mode.

The pulsator 4 is provided at the inner bottom of the clothes basket 3 to be rotated in clockwise and counter-clockwise directions. The water supplied in the clothes basket 3 is shaken causing the clothes to be rubbed together, thus executing a washing operation.

A reduction gear assembly 6 is provided beneath the water basket 3 and has a washing shaft 6*a* and a dehydrating shaft 6*b* on the upper portion of the gear assembly 6. The washing shaft 6*a* is connected with the pulsator 4, while the dehydrating shaft 6*b* is attached to the bottom portion of the clothes basket 3. The reduction gear assembly 6 is rotated in clockwise and counter-clockwise directions by the rotation of the motor 5 attached on the bottom of the water basket 2.

In the clothes washer provided as above, clothes are loaded in the water basket 3 and water is supplied into the water basket 3, proceeding with the washing mode. That is, when the motor 5 is rotated in bi-directions at the washing mode, the rotational force of the motor is transferred to the reduction gear assembly 6. The speed reduced rotational force is transferred to the pulsator 4 through the washing shaft 6*a*. The bi-directional rotation of the pulsator 4 causes swirling of the water, and the clothes are rubbed together by the swirling water to proceed with the washing operation.

In other words, when the planar pulsator 4 is rotated, plural wings radially formed on the upper surface of the pulsator 4 enable the water to be swirled. During the rotation of the pulsator, the clothes are rubbed together by the rotating water stream.

Further, when the pulsator 4 is rotated in bi-directions during the washing mode, vibration occurs in the water basket 2 due to the rotation of the clothes basket 3 and the swirling of the washing water. Since the water basket 2 is elastically suspended in the housing via the suspension rod 7, the vibration is reduced.

After the completion of the washing mode and draining of the water, the dehydrating mode proceeds. When the motor 5 is rotated at a high speed in one way direction during the dehydrating mode, the dehydrating shaft 6*b* is rotated at a high speed by the switching of the driving force transmission route, thus rotating the clothes basket 3 at a high speed.

The centrifugal force is applied to the clothes by the high speed rotation of the clothes basket 3. The clothes is spread out on the inner surface of the clothes basket 3, and the water absorbed in the clothes is dehydrated. The spun-away water is discharged to the water basket 2 through plural openings 3*a* formed at the clothes basket 3. The discharged water is drained through the drain pipe (not shown).

However, in the conventional clothes washer, the washing process proceeds utilizing the swirling water generated during the bi-directional rotation of the pulsator 4. The clothes are gathered in the center of the clothes basket to be twisted and tangled. This causes inefficient washing in respect of clothes and thus poor efficiency of the washing. That is, the rotational water stream occurs, and the clothes are rotated by the water stream. During this operation, the clothes are rubbed together, and the washing is proceeds. The swirling water gathers the clothes in the center of the clothes basket, and the clothes are twisted and tangled. The twisted and tangled clothes cannot rub together easily. Thus, washability is greatly reduced, and the washing time is also lengthened.

Furthermore, the long washing time enables the motor 5 and the reduction gear assembly 6 to be overloaded so the life of the clothes washer is shortened. More, since only a continual water stream generated by the pulsator 4 is utilized during the washing process, the efficiency of the washing is reduced.

A washer for solving the above problems is disclosed at U.S. Pat. Ser. No. 08/870,825 (Jun. 6, 1997) which is applied by the same inventor as the present invention. A pulsator apparatus of the washer comprises a driving pulsator disposed above a bottom portion of a clothes basket and rotated by a motor, and a plurality of driven pulsators rotated by the rotation of the driving pulsator around each axis of respective support shafts fixed on the side wall of the clothes basket.

In the above washer, the swirling of the water is generated by the rotation of a sun pulsator and plural satellite pulsators, and the washing efficiency can be increased. However, since the rotating plural pulsators directly make contact with the clothes, it damages soft clothes.

Further, the rotation force of the motor is transferred to plural satellite pulsators and is diminished in some portion and the remaining force is transferred to the sun pulsator. Therfore, a problem occurs that the satellite pulsator can generate insufficient swirling to the washing.

SUMMARY OF THE INVENTION

Therefore, it is an object of the present invention to provide a clothes washer having a main pulsator and plural sub-pulsators for improving the washing efficiency of the washer.

It is another object of the present invention to provide a clothes washer having a main pulsator and plural sub-pulsators for performing high efficiency washing without damage to the clothes.

It is another object of the present invention to provide a driving force of a motor that is directly and simultaneously transferred to a main pulsator and plural sub-pulsators via a driving force transmitting apparatus.

In order to achieve the above objects of the present invention, a clothes washer having a main pulsator and plural sub-pulsators comprises a housing, a water basket disposed in said housing for containing water, a clothes basket disposed in the water basket and providing a chamber at a bottom portion and the chamber partitioned by a horizontal plate, a main pulsator and plural sub-pulsators disposed in the clothes basket, a driving force selecting apparatus which is disposed between the housing and the water basket and selectively transmits a driving force to the clothes basket and the main pulsator and the plural sub-pulsators, and a driving force transmitting apparatus which is disposed in the chamber of the clothes basket and transmits simultaneously and directly the driving force to each main pulsator and sub-pulsator.

The driving force transmitting apparatus comprises a driving bevel gear fittedly connecting to a driving shaft protruded from the driving force selecting apparatus, plural side bevel gears meshed with the driving bevel gear, and a driven bevel gear which is meshed with each side bevel gear and has a driven shaft for transmitting the driving force to the main pulsator.

The sub-pulsator constitutes a bevel gear series, and the bevel gear series comprise a side gear receiving the driving force of the driving transmitting apparatus, a transfer gear meshed with the side gear, and a support gear meshed with the transfer gear.

Further, the sub-pulsators are disposed under a horizontal plate which has plural openings.

Alternatively, plural protrusions are formed on an upper surface of each gear of the bevel gear series.

BRIEF DESCRIPTION OF THE DRAWINGS

The above objects and other advantages of the present invention will be more clarified by describing a preferred embodiment thereof with reference to the accompanying drawings in which.

DESCRIPTION OF THE PREFERRED EMBODIMENT

Hereafter, the invention will be described in further detail with reference to the accompanying drawings.

Figure 1:
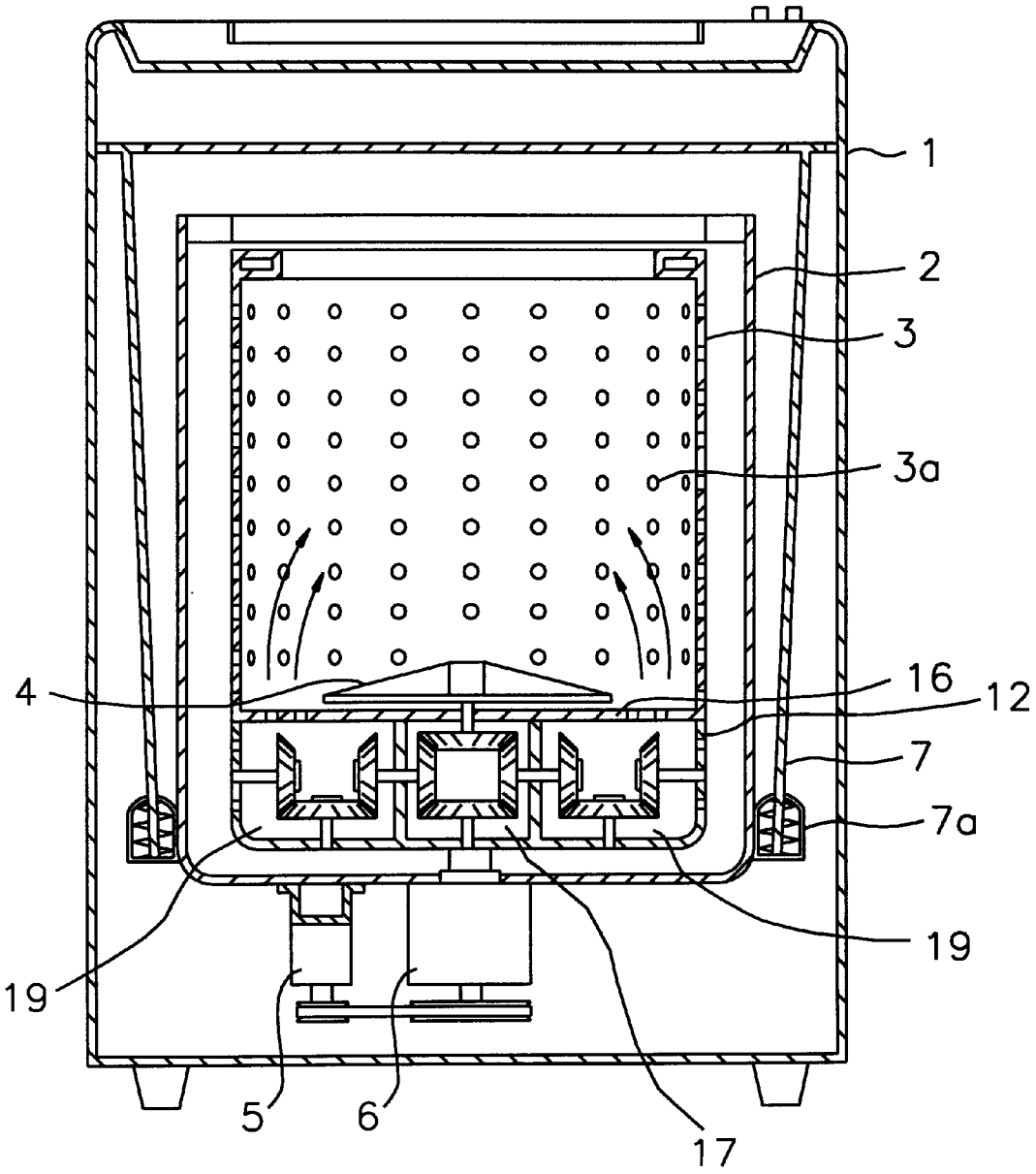
FIG. 1 is a vertical elevational view of a clothes washer having a main pulsator and plural sub-pulsators in accordance with the present invention.
Figure 2:
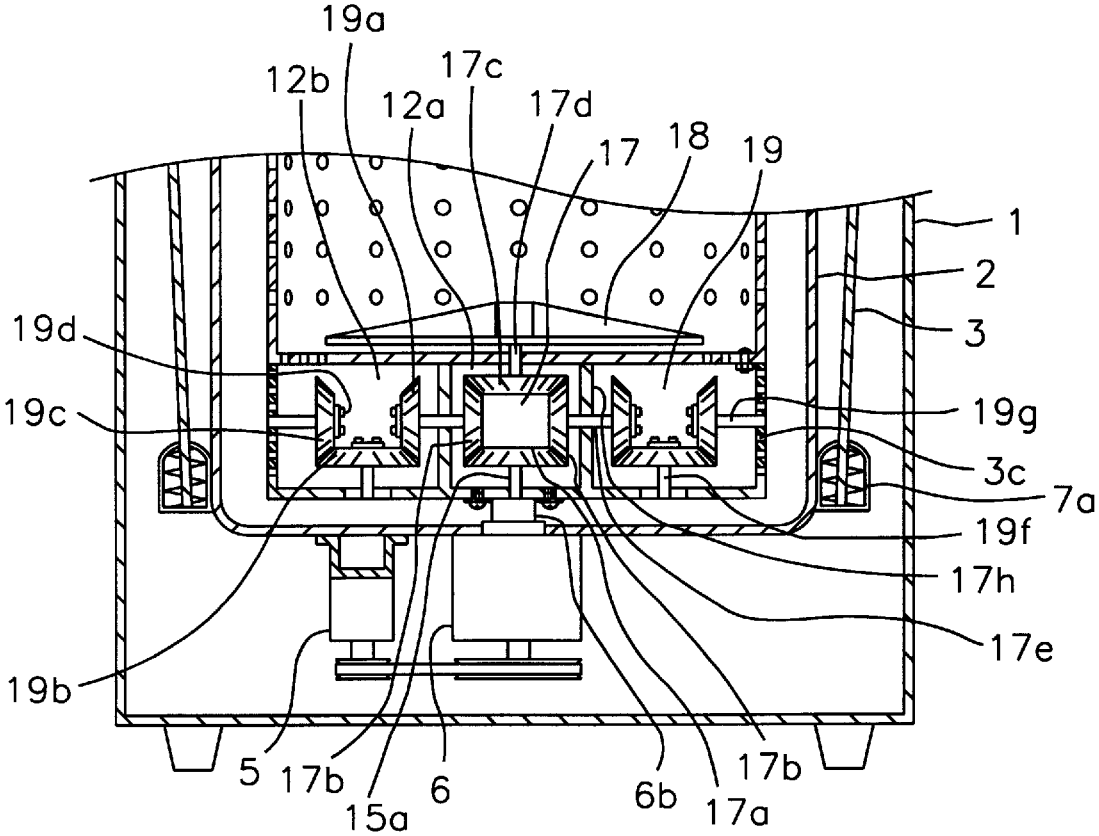
FIG. 2 is an enlarged vertical elevational view of main components of a clothes washer shown in FIG. 1.
Figure 3:
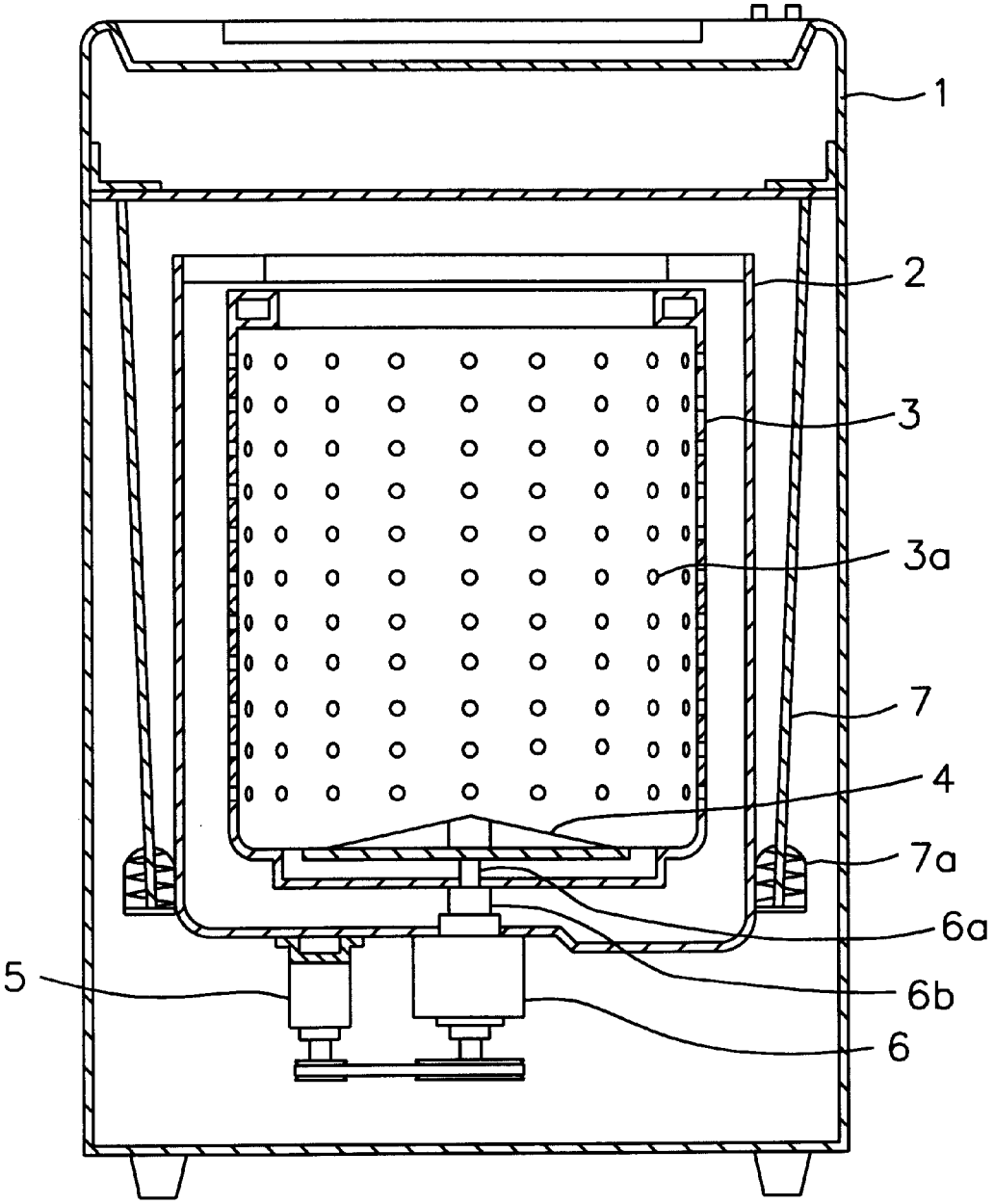
FIG.3 PRIOR ART
FIG. 3 is a vertical elevational view of the clothes washer having a pulsator in accordance with a prior art.

FIGS. 1 and 2 illustrate a clothes washer of the present invention. The component parts as those in FIGS. 1 and 2 are designated by the same reference numerals as the corresponding parts of conventional embodiment of FIG. 3, so a detailed description of those parts will be omitted.

The clothes washer comprises a housing 1, a water basket 2 disposed in the housing 1 for containing water, a clothes basket 3 disposed in the water basket 2 and providing a chamber 12 at a bottom portion and the chamber 12 partitioned by a horizontal plate 16, and a main pulsator 4 and plural sub-pulsators 19 disposed in the clothes basket 3. Further, the clothes washer comprises a driving force selecting apparatus 6 which is disposed between the housing 1 and the water basket 2 and selectively transmits a driving force to the clothes basket 3 and the main pulsator 4 and the plural sub-pulsators 10, and a driving force transmitting apparatus 17 which is disposed in the chamber 12 of the clothes basket 3 and transmits simultaneously and directly the driving force to each main pulsator 4 and sub-pulsators 19.

The chamber 12 comprises an intermediate chamber 12*a* and a circumferential chamber 12*b* which are separated by a partition wall 17*h*. The intermediate chamber 12*a* houses the driving force transmitting apparatus 17 by which the driving force of the motor 5 is transferred to the main pulsator 4 through the reduction gear assembly 6. The circumferential chamber 12*b* houses sub-pulsator 19 which is rotated by a driving force of the motor 5 via the driving force transmitting apparatus 17.

The driving force transmitting apparatus 17 comprises a driving bevel gear 17*a* fittedly connecting to a driving shaft 15*a* protruded from the gear reduction assembly 6, plural side or idle bevel gears 17*b* meshed with the driving bevel gear 17*a* for transmitting the rotational force of the driving bevel gear 15*a* to both main pulsator 4 and sub-pulsators 19, and a driven bevel gear 17*c* which is meshed with each side bevel gear 17*b* and has a driven shaft 17*d* for transmitting the driving force to the main pulsator 4.

The sub-pulsator 19 constitutes bevel gear series, and the bevel gear series comprise a side gear 19*a* receiving the driving force from the side bevel gear 17*b* through a connecting shaft 17*e*, a transfer gear 19*b* meshed with the side gear 19*a* and fixedly connected to the rotational shaft 19*f*, and a support gear 19*c* meshed with the transfer gear 19*b* and fixedly connected to the rotational shaft 19*g*. Further, plural protrusions 19*d* are formed on an upper surface of each gear 19*a*, 19*b*, 19*c* of the sub-pulsator 19 and thus strong swirling water is generated in the circumferential chamber 12*b*. The bevel gear may have straight, curved, or spiral teeth. In this embodiment, straight teeth are employed.

Two sub-pulsators 19 are illustrated in FIG. 2, but more than two are employed, if necessary.

Plural openings 16*c* are formed at the horizontal plate 16 adjacent to each sub-pulsator 19 through which the water of the chamber 12 flows to the washing basket 3. Further, a wall of the washing basket 3 which is the outer wall of the chamber 12 has plural openings 3*c* also. The water of the clothes basket 2 flows to the chamber 12 through the openings 3*c*.

The clothes washer according to the present invention constructed as above is operated as below.

The washing mode starts according to a predetermined program, then the operating force of the motor 4 is transmitted to the reduction gear assembly 5. The driving shaft 15*a* of the reduction gear assembly 5 rotates, and then the driving bevel gear 17*a* of the driving transferring apparatus 17 is rotated. Thus, the side bevel gear 17*b* is also rotated, and the driven bevel gear 17*c* is rotated. The rotation of the driven bevel gear 17*c* enables the main pulsator 4 fixed to the driven shaft 17*d* to be rotated.

Simultaneously, the connecting shaft 17*e* fixed to the side bevel gear 17*b* is rotated, and the side bevel gear 19*a* which is one component of the sub-pulsator 19 is rotated. Therefore, the transfer gear 19*b* meshed with the side bevel gear 19*a* is rotated, and next the support gear 19*c* is rotated.

The water swirling in the chamber 12 occurs due to the rotational force of the sub-pulsator 19 constituted of a series of bevel gears 19*a*, 19*b*, 19*c*. The swirling waterflow is discharged to the washing basket 3 through the opening 16*c* formed at the horizontal plate 16. The discharged flow collides with the steady rotational flow generated by the main pulsator 4, so the water of the clothes basket has a sufficient strong swirling effect.

That is, the rotational water stream is generated by the rotation of the sub-pulsator 19, and the swirling is combined with the water stream generated by the main pulsator 4, thus the strong swirling occurs. The strong swirling is applied to the clothes to make the clothes clean.

According to the present invention as described above, the main pulsator is provided in the clothes basket and a plurality of sub-pulsators are provided at the chamber formed at the lower portion of the clothes chamber, and a driving force of a motor is directly and simultaneously transferred to a main pulsator and plural sub-pulsators via a driving force transmitting apparatus. Since plural pulsators directly make contact with the clothes during the washing mode, the clothes are not damaged.

Further, since the driving force of the motor is transferred to the main pulsator and plural sub-pulsators without any loss of the driving motor force, high washing efficiency is achieved by the strong swirling generated by the main pulsator and plural sub-pulsators.

What is claimed:

1. A clothes washer having a main pulsator and plural sub-pulsators comprising:

a housing;

a water basket disposed in said housing for containing water;

a clothes basket disposed in said water basket and providing a chamber at a bottom portion and said chamber partitioned by a horizontal plate;

a main pulsator and plural sub-pulsators disposed in said clothes basket;

a driving force selecting means which is disposed between said housing and said water basket and selectively transmits a driving force to said clothes basket and said main pulsator and said plural sub-pulsators; and a driving force transmitting means which is disposed in said chamber of said clothes basket and transmits simultaneously and directly the driving force to each main pulsator and sub-pulsator, said driving force transmitting means including a driving bevel gear fittedly connecting to a driving shaft protruded from said driving force selecting means, plural side bevel gears meshed with said driving bevel gear, and a driven bevel gear which is meshed with each side bevel gear and has a driven shaft for transmitting the driving force to said main pulsator, wherein each sub-pulsator constitutes bevel gear series which includes a side gear receiving the driving force of said driving force transmitting means, a transfer gear meshed with said side gear, and a support gear meshed with said transfer gear.

2. The clothes washer in accordance with claim 1, wherein said sub-pulsators are disposed under said horizontal plate which has plural openings.

3. The clothes washer in accordance with claim 1, wherein plural protrusions are formed on an upper surface of each gear of said bevel gear series.

4. A clothes washer comprising a water basket disposed in a housing, a clothes basket disposed in said water basket for containing clothes, and a reduction gear assembly connected to a driving motor for rotating said water basket; said clothes washer comprising:

a driving apparatus comprising a driving bevel gear connected to said driving motor, plural idle bevel gears meshedly disposed on said driving bevel gear, and a driven bevel gear meshedly disposed on each idle bevel gear and fittedly connected with a rotational shaft of a main pulsator; and a sub-pulsator constituting bevel gear series which are rotated by a rotation of said idle bevel gear for producing swirling water.

5. The clothes washer in accordance with claim 4, wherein said bevel gear series are a side gear for transmitting the driving force of said driving apparatus, a transfer gear meshed with said side gear, and a support gear meshed with said transfer gear.

6. The clothes washer in accordance with claim 5, wherein plural protrusions are formed on an upper surface of each gear of said bevel gear series.

7. A clothes washer comprising a main pulsator rotatably disposed in a water basket and operated by a motor; said clothes washer comprising a driving apparatus by which the driving force of said motor is directly transferred to said main pulsator and is simultaneously directly transferred to a sub-pulsator which is constituted by bevel gear series, and is disposed under said main pulsator.

* * * * *